US012139829B2

(12) United States Patent
Zheng

(10) Patent No.: US 12,139,829 B2
(45) Date of Patent: Nov. 12, 2024

(54) SWIVEL CONNECTOR ASSEMBLY

(71) Applicant: Westing Bridge LLC, Troy, MI (US)

(72) Inventor: Liyun Zheng, Troy, MI (US)

(73) Assignee: Westing Bridge LLC, Troy, MI (US)

( * ) Notice: Subject to any disclaimer, the term of this patent is extended or adjusted under 35 U.S.C. 154(b) by 89 days.

(21) Appl. No.: 17/730,701

(22) Filed: Apr. 27, 2022

(65) Prior Publication Data

US 2022/0349095 A1 Nov. 3, 2022

Related U.S. Application Data

(60) Provisional application No. 63/180,833, filed on Apr. 28, 2021.

(51) Int. Cl.

| | |
|---|---|
| ***D04B 3/02*** | (2006.01) |
| ***D04B 3/00*** | (2006.01) |
| ***D04B 9/02*** | (2006.01) |

(52) U.S. Cl.

CPC ..... *D04B 3/02* (2013.01); *D04B 3/00* (2013.01); *D04B 9/02* (2013.01)

(58) Field of Classification Search

CPC ... D04B 3/02; D04B 3/00; D04B 9/02; D04B 35/02; A44C 5/2057; A44C 5/2061

USPC ..... 66/121, 123, 116, 117

See application file for complete search history.

(56) References Cited

U.S. PATENT DOCUMENTS

| | | | |
|---|---|---|---|
| 1,269,014 | A | 6/1918 | Stansbery |
| 1,960,133 | A | 5/1934 | Garo |
| 1,989,352 | A | 1/1935 | Davis |
| 1,999,691 | A | 4/1935 | Ghaham |
| 2,043,958 | A | 6/1936 | Engel |
| 2,061,282 | A | 11/1936 | Leboff et al. |
| 2,093,631 | A | 9/1937 | Burnham |
| 2,094,262 | A | 9/1937 | Burnham |
| 2,096,482 | A | 10/1937 | Cook et al. |
| 2,096,483 | A | 10/1937 | Cook |
| 2,102,600 | A | 12/1937 | Miller |
| 2,118,210 | A | 5/1938 | Luther |

(Continued)

FOREIGN PATENT DOCUMENTS

| | | | |
|---|---|---|---|
| CN | 2514012 | Y | 10/2002 |
| CN | 202865519 | U | 4/2013 |

(Continued)

OTHER PUBLICATIONS

Clara Parkes, "ChiaoGoo Twist and Spin Interchangeable Needles", Electronic Colloquium, dated Nov. 28, 2012, Knitter's Review (4 pages).

(Continued)

*Primary Examiner* — Aiying Zhao

(74) *Attorney, Agent, or Firm* — Van Hoven PC; Stefan D. Osterbur; Joshua Van Hoven

(57) ABSTRACT

Example knitting needle connector assemblies, e.g., for a knitting needle or crochet tool, may include first and second members. The first member may be generally cylindrical and have a radially facing slot extending circumferentially about a longitudinal axis of the first member. The second member may have one or more radially projecting pins received in the slot, wherein the one or more pins are movable about the circumferentially extending slot such that the first member is rotatable with respect to the second member about the longitudinal axis.

13 Claims, 5 Drawing Sheets

(56) References Cited

U.S. PATENT DOCUMENTS

| | | | | | |
|---|---|---|---|---|---|
| 2,128,871 | A | | 8/1938 | Wong | |
| 2,133,431 | A | | 10/1938 | Craft | |
| 2,183,791 | A | | 12/1939 | Dunn | |
| 2,208,124 | A | | 7/1940 | Robert | |
| 2,230,495 | A | | 2/1941 | Walter | |
| 2,242,880 | A | | 5/1941 | Dunn | |
| 2,462,473 | A | | 2/1949 | Delaney | |
| 2,507,174 | A | | 5/1950 | Phillips | |
| 2,535,315 | A | * | 12/1950 | Morrison | D04B 3/02 66/117 |
| 2,633,720 | A | | 4/1953 | Robbins | |
| 2,693,095 | A | | 11/1954 | Slingsby | |
| 2,695,506 | A | | 11/1954 | Walter | |
| 2,817,221 | A | | 12/1957 | Newton | |
| 3,097,474 | A | | 7/1963 | Rohdenburg | |
| 3,212,301 | A | * | 10/1965 | Sumegi | D04B 17/04 66/117 |
| 3,280,595 | A | | 10/1966 | Linstead | |
| 3,384,220 | A | | 5/1968 | Linstead | |
| 3,540,452 | A | | 11/1970 | Usher et al. | |
| 3,603,115 | A | | 9/1971 | Elzey et al. | |
| 3,927,538 | A | | 12/1975 | Martella | |
| 4,007,610 | A | | 2/1977 | Linstead | |
| 4,108,701 | A | | 8/1978 | Stanley | |
| 4,195,496 | A | | 4/1980 | Rawlins et al. | |
| 4,341,094 | A | | 7/1982 | Heide | |
| 4,494,387 | A | | 1/1985 | Phipps et al. | |
| 4,501,133 | A | | 2/1985 | Kretzschmar et al. | |
| 4,553,410 | A | | 11/1985 | Okada | |
| 4,646,543 | A | | 3/1987 | Okada | |
| 4,680,947 | A | | 7/1987 | Phipps et al. | |
| 4,693,094 | A | | 9/1987 | Kahn | |
| 4,846,351 | A | | 7/1989 | Gardiner | |
| 5,008,984 | A | * | 4/1991 | Levy | A44C 5/2042 24/616 |
| 5,211,710 | A | | 5/1993 | Nagano | |
| 5,303,498 | A | | 4/1994 | Yutori et al. | |
| 5,720,187 | A | | 2/1998 | Matuo | |
| 6,397,640 | B1 | | 6/2002 | Williams | |
| 6,668,597 | B2 | | 12/2003 | Robinson | |
| 6,983,627 | B1 | | 1/2006 | Eley-Holden-Sotnik | |
| 7,117,693 | B1 | | 10/2006 | Nova | |
| 7,954,342 | B2 | | 6/2011 | Devagnanam | |
| 8,181,489 | B2 | | 5/2012 | Selter | |
| 8,210,003 | B2 | | 7/2012 | Zheng | |
| 8,464,559 | B2 | | 6/2013 | West et al. | |
| 8,499,586 | B1 | | 8/2013 | Adam | |
| 9,181,641 | B1 | | 11/2015 | Moraca | |
| 10,443,164 | B1 | | 10/2019 | Zheng et al. | |
| 10,619,273 | B2 | | 4/2020 | Zheng et al. | |
| 11,060,216 | B2 | | 7/2021 | Zheng | |
| 11,299,830 | B2 | | 4/2022 | Zheng | |
| 2003/0145442 | A1 | * | 8/2003 | Hoshino | A44C 5/2061 24/663 |
| 2010/0139059 | A1 | * | 6/2010 | Nagai | A44C 5/2095 24/700 |
| 2011/0197636 | A1 | * | 8/2011 | Selter | D04B 3/02 66/117 |
| 2012/0118021 | A1 | | 5/2012 | Zheng | |
| 2019/0203391 | A1 | * | 7/2019 | Rasch | D04B 3/02 |
| 2019/0284736 | A1 | | 9/2019 | Zheng et al. | |
| 2020/0040494 | A1 | | 2/2020 | Zheng | |

FOREIGN PATENT DOCUMENTS

| | | | | | |
|---|---|---|---|---|---|
| DE | 20116646 | U1 | * | 12/2001 | A44C 5/2057 |
| DE | 20117288 | U1 | | 2/2003 | |
| GB | 404798 | A | | 1/1934 | |

OTHER PUBLICATIONS

Clara Parkes, "Knit Picks Options", Electronic Colloquium, dated Jun. 29, 2006, Knitter's Review (4 pages).

DyakCraft webpage from Internet Archive (https://web.archive..org/web/20160529000418/http://www.dyakcraft.com:80/store/p12/Heavy_Metal%E2%84%A2_Tips.html), dated May 28, 2016, 2 pages.

International Search Report and Written Opinion for Application No. PCT/US19/22396 dated May 23, 2019 (12 pages).

* cited by examiner

SWIVEL CONNECTOR ASSEMBLY

CROSS REFERENCE TO RELATED APPLICATION

The present application claims the benefit of United States Provisional Patent Application No. 63/180,833, filed Apr. 28, 2021, which is hereby incorporated by reference herein in its entirety.

FIELD

This disclosure relates to use of knitting needles or crochet tools. More particularly, this disclosure relates to knitting needle members or crochet tools that swivel with respect to a cable.

BACKGROUND

The background description provided herein is for the purpose of generally presenting the context of the disclosure. Work of the inventors hereof, to the extent the work is described in this background section, as well as aspects of the description that may not otherwise qualify as prior art at the time of filing, are neither expressly nor impliedly admitted to be prior art against the subject matter of the present disclosure.

A circular knitting needle generally includes two knitting needle tips joined by a flexible cable. When used in knitting, one or both needle tips may be twisted, turned, or rotated, applying torque to the flexible cable, and eventually causing the flexible cable to twist or wind up. Twisting of the cable may make knitting more difficult, requiring one or both knitting needles to be released from the user's hand(s) to unwind or straighten the cable.

SUMMARY

In at least some example approaches, a knitting needle connector assembly may include a female member defining a bore, the bore having one or more radially inwardly protruding pins. The knitting needle connector assembly may also include a male member inserted into the bore of the female member, the male member defining a circumferentially extending radially outwardly facing slot receiving the one or more pins. The one or more pins are movable about the circumferentially extending slot such that the male member is rotatable with respect to the female member about a common longitudinal axis.

In at least some example approaches, a knitting needle connector assembly may include a first member and a second member. The first member may be generally cylindrical and have a radially facing slot extending circumferentially about a longitudinal axis of the first member. The second member may have one or more radially projecting pins received in the slot, wherein the one or more pins are movable about the circumferentially extending slot such that the first member is rotatable with respect to the second member about the longitudinal axis.

In at least some example approaches, a knitting needle assembly includes a cable having opposing ends, with each opposing end having a knitting needle tip. The knitting needle assembly may further include at least one knitting needle connector assembly coupling one of the knitting needle tips to its respective end. The knitting needle connector assembly may include a female member defining a bore, with the bore having a radially inwardly protruding pin. The knitting needle connector assembly may also include a male member inserted into the bore of the female member, with the male member defining a circumferentially extending radially outwardly facing slot receiving the pin. The pin may be movable about the circumferentially extending slot such that the male member is rotatable with respect to the female member about a common longitudinal axis.

BRIEF DESCRIPTION OF THE DRAWINGS

Further features of the disclosure, its nature, and various advantages, will be apparent upon consideration of the following detailed description, taken in conjunction with the accompanying drawings, in which like reference characters refer to like parts throughout, and in which.

DETAILED DESCRIPTION

It may be desirable to provide a connector assembly in a knitting needle assembly with a swivel or other assembly that allows relative rotation between needles or crochet members at opposite ends of a connecting cable. Merely as examples, swiveling connector assemblies are disclosed in U.S. Pat. Nos. 10,443,164, 11,060,216, 11,299,830, each of which are hereby expressly incorporated by reference in their entireties.

In the present disclosure, various examples of a knitting needle connector assembly each generally include first and second members. The first member may be generally cylindrical and have a radially facing slot extending circumferentially about a longitudinal axis of the first member. The second member has one or more radially projecting features, e.g., pins, which may be received in the slot of the first member. The one or more pins may be movable about the circumferentially extending slot such that the first member is rotatable with respect to the second member about the longitudinal axis. The first member may be joined to a knitting needle tip, while the second member may be joined to a flexible cable, or vice versa. In some example approaches, the first member is a female member, and the second member is a male member, with the male member received in a bore of the female member. In other alternative approaches, the first member is a male member, and the second member is a female member, with the male member received in a bore of the female member. Accordingly, circumferentially facing slots described herein may be defined by either a male or female member (and may face radially outwardly or inwardly, respectively), and radially projecting pin(s) described herein may also be provided on either a female or male member (and may face radially inwardly or outwardly, respectively).

As noted above, in some of the illustrated example approaches, a knitting needle connector assembly includes a generally cylindrical female member defining a bore, the bore having a radially inwardly protruding pin, and a male member inserted into the bore of the female member. The male member may define a circumferentially extending, radially outwardly facing slot receiving the pin of the female member. The pin is movable about the circumferentially extending slot such that the male member is freely rotatable with respect to the female member about a common longitudinal axis. While the illustrated examples indicate the female member is coupled to a knitting needle cable and the male member is coupled to a knitting needle tip, in other examples this orientation may be reversed (i.e., the male member may instead be coupled to a knitting needle cable, with the female member coupled to a knitting needle tip).

Figure 1:
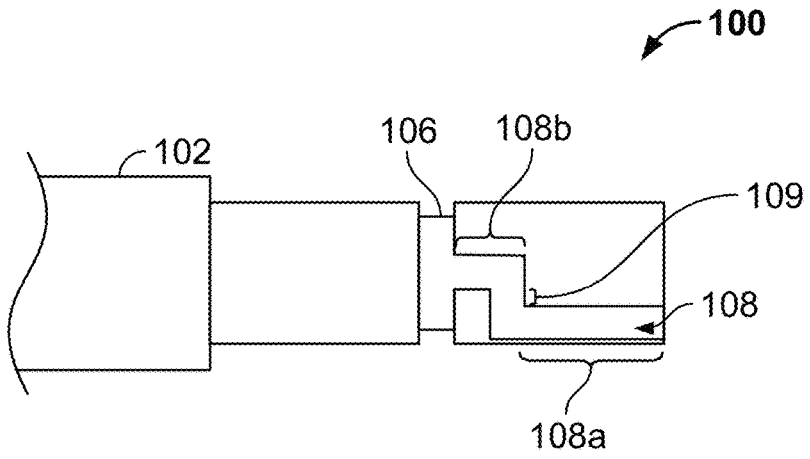
FIG. 1 is a depiction of a male member with a Z-shaped longitudinal slot coupled to a knitting needle tip, in accordance with some implementations of the subject matter of this disclosure.

FIG. 1 is a depiction of a male member 100 with a Z-shaped longitudinal slot 108 coupled to a knitting needle tip 102, in accordance with some implementations of the subject matter of this disclosure. The slot 108 may face radially outwardly from the member 100, e.g., to receive one or more radially projecting features of a corresponding female member (not shown in FIG. 1). The male member 100 includes a circumferentially extending radially outwardly facing slot 106 which is met by one or more undulating or Z-Shaped longitudinally extending slots 108. The longitudinally extending slot(s) 108 thus may include longitudinally extending portion(s) 108*a* and 108*b* with a laterally extending portion 109 interposed therein. The radially outwardly facing slot(s) 106 and 108 (including portions 108*a*, 108*b*, and 109 of the slot 108) are each configured to receive a corresponding radially inwardly protruding pin of the female member when the male member 100 is inserted into a female member. More specifically, the male member 100 may be inserted into the bore of the female member such that the pin of the female member is received in the longitudinally extending slot 108 at the end of the male member 100 (rightward-most portion of the male member 100 in FIG. 1). In some embodiments, the circumferentially extending outwardly facing slot 106 provides the ability for the male member 100 and knitting needle tip 102 to swivel relative to the female member along a common longitudinal axis.

Figure 2:
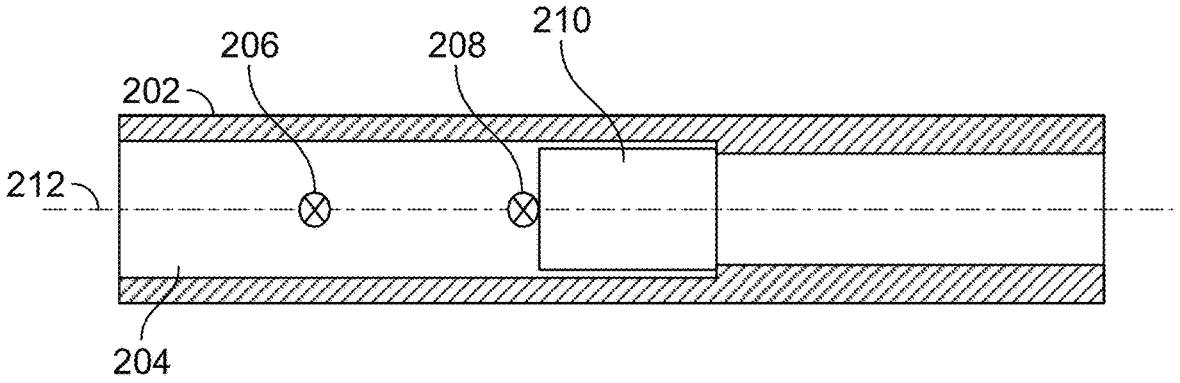
FIG. 2 is an exemplary depiction of a magnetic female member with two pins according to implementations of the subject matter of this disclosure.

FIG. 2 is partial section view of an exemplary depiction of a female member 202 with two radially inwardly protruding pins 206, 208 according to implementations of the subject matter of this disclosure. In some embodiments, a magnet 210 is retained in a bore 204 defined by the female member 202, by a first one or more of radially inwardly protruding pin(s) 208. The first one or more of radially inwardly protruding pin(s) 208 may be configured to retain the magnet 210 in the bore 204 of the female member 202 and may be spaced longitudinally from a second one or more of radially inwardly protruding pin(s) 206. The second one or more of radially inwardly protruding pins 206 may be configured to engage with the longitudinally extending slot 108 of the male member 100, as will be described further below. In some embodiments, the second one or more of radially inwardly protruding pins 206 engages with the longitudinally extending slot 108, until the pin 206 engages with the circumferentially extending radially outwardly facing slot 106 of the male member 100. For example, if the male member 100 has an undulating or Z-shaped longitudinal extending slot 108, the second one or more radially inwardly protruding pin 206 rotate relative to the male member 100 along a common longitudinal axis 212 to allow the male member 100 to be fully inserted into the bore 204 of female member 202. The magnet 210 may aid in the retention of the male member 100, which may be formed of a magnetically susceptible or ferromagnetic material, within the female member 202. In some embodiments, the retention force applied by the magnet 210 advantageously biases the male member 100 and the female member 202 together, i.e., in an insertion direction of the male member into the female member 202. In contrast, previous approaches such as bayonet catches or the like may tend to eject corresponding members apart, depending on rotational alignment. Moreover, it should also be noted that the male member 100 may be magnetized or may carry a magnet (not shown) such that the male member is configured to cooperate with the magnet 210 of the female member 202 to further enhance retention of the male member 100 within the female member 202. For example, the male member 100 or a magnet carried by the male member 100 may have an opposite polarity to the magnet 210 of the female member 202, thereby increasing retention of the male member 100 within the female member 202. While magnet 210 herein is shown being retained by a radially inwardly protruding pin 208, the magnet 210 may alternatively or in addition be retained by a press-fit engagement, adhesive/glue, or bonding, merely as examples. Further, while the pin 208 is shown being crimped on a left side of the magnet 210, it may be positioned anywhere where it aids in retention of the magnet 210, as discussed further below in the example illustrated in FIG. 3. In some embodiments, the second radially inwardly protruding pin 206 and/or pin 208 of the female member 202 may be formed by crimping, or any other method that is convenient. To the extent radially projecting features such as pins are formed in a female member, e.g., to extend radially inwardly, punching or crimping operations may be used to form the radially inwardly projecting features. In examples where radially projecting features such as pins are formed in a male member, e.g., to extend radially outwardly, material addition operations such as soldering may be used to form the radially outwardly projecting features. It should be noted that while one pin 208 is mentioned for retaining the magnet 210 and one pin 206 is mentioned for engaging the slot of a male member in the present example, one or more additional pins may be provided that protrude radially inwardly from the female member 202, e.g., for engaging into additional longitudinally extending slot(s) defined by the male member 100, or increasing retention of the magnet 210. In some embodiments, the female member 202 is coupled to a flexible cable (not pictured in FIG. 2) on the opposite side of the bore 204 of the female member 202. It should be noted that magnetic force acting between the members 202 and 100 may be increased in various ways. Merely as examples, a relatively larger cross-sectional area of the magnet 210 may impart relatively greater magnetic force. Alternatively, a greater intensity of magnetic field, e.g., as provided by a "super" magnet or the like, may also relatively increase magnetic force. A magnetically insulating cover (not shown) may also be employed to focus a magnetic field generated by a magnet. Further, as mentioned below, a second magnet may be provided in an opposite member, e.g., in male member 100, having an opposite polarity so as to increase magnetic attraction by working in cooperation with the magnet 210.

Figure 3:
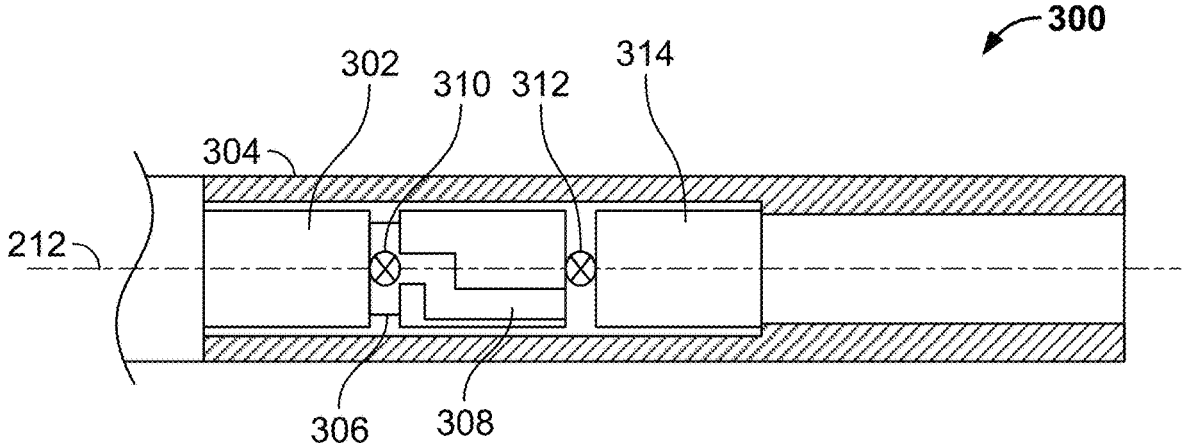
FIG. 3 shows a view of the exemplary connector assembly of FIG. 1 inserted into the female member of FIG. 2, according to some implementations of the subject matter of this disclosure.
Figure 5:
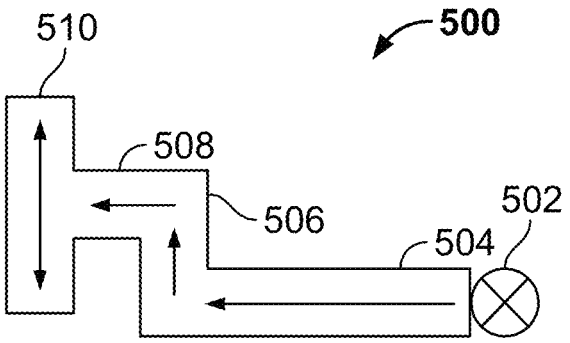
FIG. 5 shows a progression to engage a pin through an exemplary Z-shaped longitudinal slot in accordance with some implementations of the subject matter of this disclosure.
Figure 6:
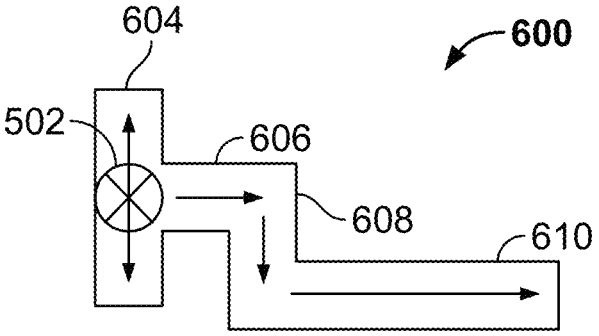
FIG. 6 shows a progression to disengage a pin through an exemplary Z-shaped longitudinal slot in accordance with some implementations of the subject matter of this disclosure.

FIG. 3 shows a view of an exemplary connector assembly 300 having a male member 302 with a Z-shaped longitudinally extending slot 308 and a female member 304 with two pins 310, 312, according to some implementations of the subject matter of this disclosure. The female member 304 may have a magnet 314 seated within the bore of the female member 204 and retained within the bore by the pin 312. While the pin 312 is illustrated as being aligned with the pin 310 about the circumference of the female member 304, the pin 312 may be displaced from the pin 310 about the circumference of the female member 304. Moreover, the pin 312 may be positioned anywhere else convenient for retaining the magnet 314. Merely as one example, the pin 312 may be shifted longitudinally along the female member 304 such that it engages a side of the magnet 314 and is spaced longitudinally away from the male member 302, thereby reducing a potential for interference with rotation of the male member 302 within the female member 304. In an example, the male member 302 is male member 100 of FIG. 1, and female member 304 is female member 202 of FIG. 2. In some embodiments, as the male member 302 is inserted further into the female member 304, the second radially inwardly protruding pin 310 of the female member 304 travels along the longitudinally extending slot 308. In some implementations of this Z-shaped longitudinally extending slot 308, the male member 302 is rotated relative to the female member 304 to allow the male member 302 to be fully inserted into the female member 304, such that the second radially inwardly protruding pin 310 of the female member 304 travels along the Z-shaped longitudinally extending slot 308 and reaches the circumferentially extending radially outwardly facing slot 306 of the male member 302. In some embodiments, with the second radially inwardly protruding pin(s) 310 of the female member 304 disposed in the circumferentially extending radially outwardly facing slot 306 of the male member 302, the male member 302 and the female member 304 may be rotated with respect to each other about their common longitudinal axis 212, allowing the two members to swivel relative to each other. An example progression (see arrows) to engage a pin through an exemplary Z-shaped longitudinal slot 500 in accordance with some implementations of the subject matter of this disclosure is illustrated in further detail at FIG. 5. More specifically, a pin 502 is illustrated traveling along a longitudinally extending slot 504 in a first relative motion, and along laterally extending slot 506 when the pin 502 and slot are rotated relative to each other (e.g., by rotating male member 302 within female member 304 about common axis 212). The pin 502 may be moved further along the slot 500 with an additional relative longitudinal movement depicted at 508, with the pin eventually being received in a circumferentially extending slot in which the pin 502 may be moved. Accordingly, the pin 502 may permit relative rotation or swiveling with respect to the circumferentially extending slot 510. The process of disengaging connector members may be accomplished by performing these movements in reverse, e.g., as illustrated in FIG. 6. More specifically, FIG. 6 shows a progression (see arrows) to disengage pin 502 through an exemplary Z-shaped longitudinal slot 600 in accordance with some implementations of the subject matter of this disclosure. In an example, the slot 600 is slot 500 as described in FIG. 5. The pin 502 may be positioned to enter the longitudinal slot 606 from the circumferential slot 604, and the pin 502 moved along the slot 606 to laterally extending portion 608. The pin 502 may then be moved along the laterally extending portion 608 to longitudinal portion 610. The pin 502 may then be moved out of the longitudinal portion 610, e.g., by withdrawing male member 302 from the female member 304.

Although FIG. 3 illustrates a connector assembly 300 of a male member 302 coupled to a knitting needle tip 102 inserted into a female member 304 coupled to a knitting needle cable (not pictured in FIG. 3), alternatively, the female member 304 may be configured to couple to the knitting needle tip 102 and the male member 302 may be configured to couple to the knitting needle cable (not pictured in FIG. 3). In some embodiments of the connector assembly 300, the male/female members may be disengaged generally by reversing the insertion process of the male member 302 to the female member 304. Accordingly, the example knitting needle connector assembly 300 of FIG. 3 may lend itself to interchangeable knitting needle applications, e.g., where a plurality of different knitting needle tips or members may be connected to a knitting needle cable.

Figure 4:
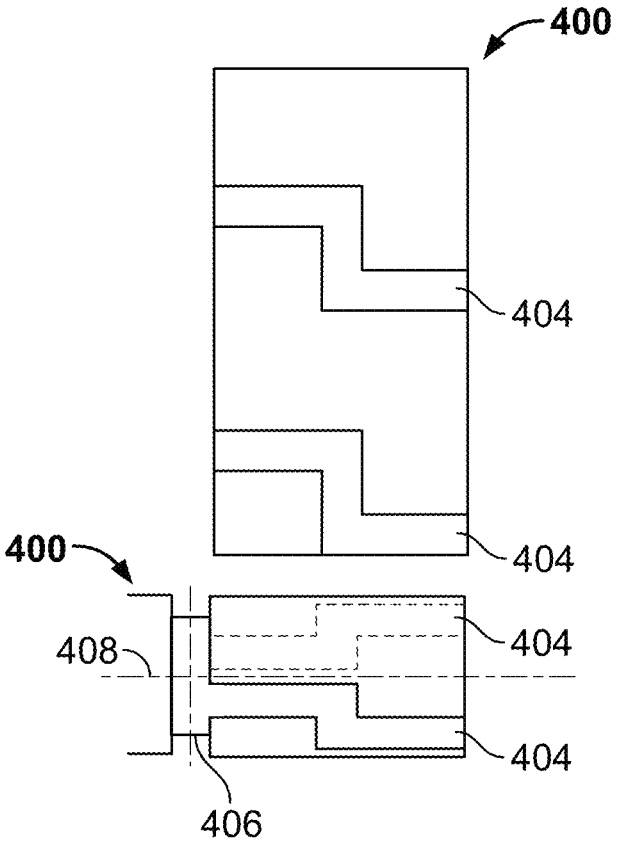
FIG. 4 is a depiction of a male member section with an expanded view of two Z-shaped slots, according to some implementations of the subject matter of this disclosure.

Example male members such as male member 100 of FIG. 1 and/or male member 302 of FIG. 3 have been described herein with a single z-shaped slot 108/308. Multiple slots may be provided in some example approaches, however. For example, FIG. 4 is a depiction of an outer surface of a male member section 400 with an expanded/unrolled view of two Z-shaped slots 404 positioned on opposite sides of the member 400, according to some implementations of the subject matter of this disclosure. The male member 400 also includes a circumferential slot 406 connected with the z-shaped slots 404 similar to the description above regarding male member 100. It should be understood that a female member receiving male member 400 may have pins (not shown in FIG. 4) corresponding to the multiple z-shaped slots, e.g., pins on opposite sides of the female member that may thereby engage with the oppositely positioned z-shaped slots 404. In this example, the slots 404 may be spaced apart about a circumference of the male member section 400 by 180 degrees, i.e., such that the slots 404 are positioned on opposite sides of the male member section 400. Further, pin(s) engaging the slots 400 may also be spaced apart about a circumference of a female member (not shown in FIG. 4) to generally match spacing of the slots 404 about the circumference of the male member 400. Any number of longitudinally extending slots such as the z-shaped slots 404 may be employed by an example connecting member.

Figure 7:
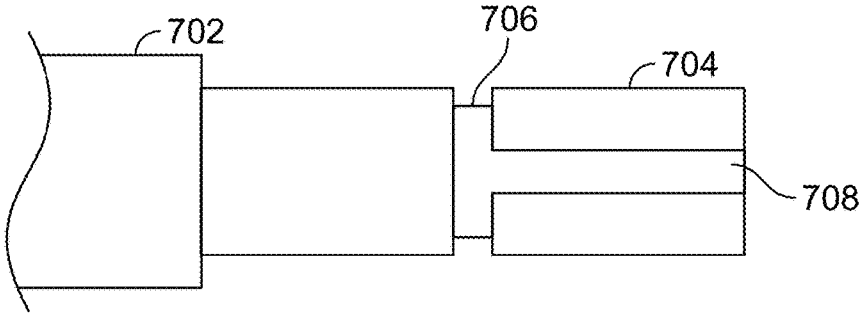
FIG. 7 is an exemplary depiction of a male member with an I-shaped longitudinal slot, in accordance with some implementations of the subject matter of this disclosure.

FIG. 7 is an exemplary depiction of a ferromagnetic male member 704 with an I-shaped longitudinal slot 708, in accordance with some implementations of the subject matter of this disclosure. The male member 704 is substantially identical to the male member 100 in FIG. 1 with the exception that male member 704 defines a straight or I-shaped longitudinally extending slot 708 instead of an undulating or Z-shaped longitudinally extending slot 108. Put another way, the slot 708 is straight and does not have a laterally extending portion (e.g., like the portion 109 of slot 108 illustrated in FIG. 1). In some embodiments, the circumferentially extending outwardly facing slot 706 is met by one or more of the I-shaped longitudinally extending slots 708. In some embodiments the male member 704 is coupled with a knitting needle tip 702. Alternatively, the male member 704 may be coupled to the flexible cable.

Figure 8:
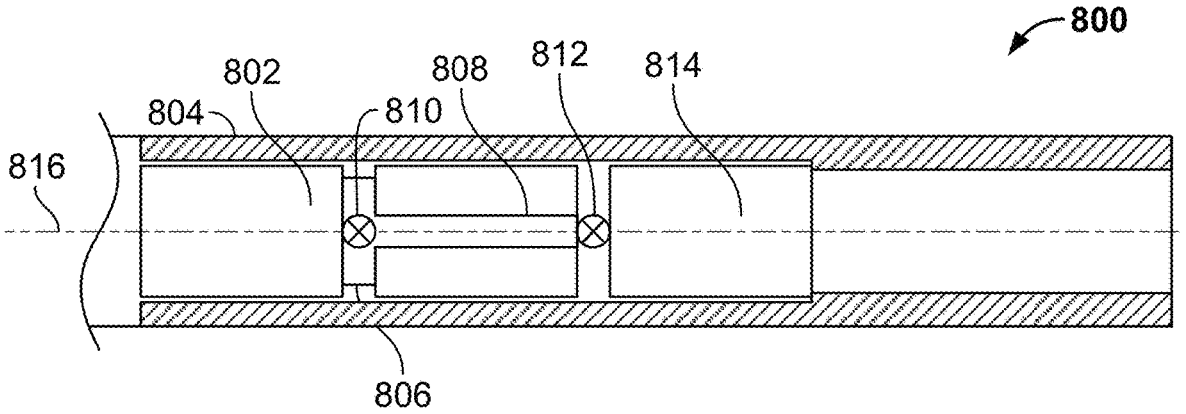
FIG. 8 is a view of the exemplary connector assembly of FIG. 7 inserted in a magnetic female member with two pins, according to some implementations of the subject matter of this disclosure.

FIG. 8 is a view of an exemplary connector assembly 800 of a ferromagnetic male member 802 with an I-shaped longitudinally extending slot 808 and a magnetic female member 804 with two pins 810, 812, according to some implementations of the subject matter of this disclosure. In an example, the male member 802 is male member 704 of FIG. 7. As noted above, in examples of an I-shaped longitudinally extending slot 808 the male member 802 may not need to be rotated relative to the female member 804 about axis 816 in order to pass the second radially inwardly facing pin 810 of the female member 804 through the I-shaped longitudinally extending slot 808 in the knitting needle connector assembly 800. In some embodiments, knitting needle connector assembly 800 may thus provide a relatively easier or more simple insertion/removal of the male member 802 with respect to the female member 804. In contrast, the knitting needle connector assembly 300 in FIG. 3 provides greater retention of the male member 302 to the female member 304 once inserted (i.e., by requiring relative rotation of the male/female members during removal). In order to fully engage the radially inwardly protruding pins 810 of the female member 804 into the circumferentially extending outwardly facing slot 806, the pins 810 may engage with the longitudinally extending slot 808 until the male member 802 is fully inserted into the female member 804. Once fully inserted, the male member 802 and female member 804 may be rotated with respect to each other about their common longitudinal axis 816, allowing the two members to swivel relative to each other. In some embodiments of the connector assembly 800, the male/female members may be disengaged generally by reversing the insertion process of the male member 802 to the female member 804. Accordingly, the example knitting needle connector assembly 800 of FIG. 8 may lend itself to interchangeable knitting needle applications, e.g., where a plurality of different knitting needle tips or members may be connected to a knitting needle cable.

Figure 9:
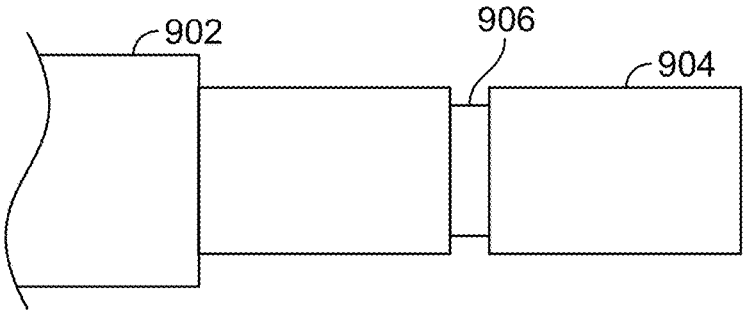
FIG. 9 is a depiction of a male member with a circumferential slot and having no longitudinal slot, in accordance with some implementations of the subject matter of this disclosure.

FIG. 9 is a depiction of a ferromagnetic male member 904 without a longitudinally extending slot, in accordance with some implementations of the subject matter of this disclosure. In some implementations, the male member 904 has a circumferentially extending radially outwardly facing slot 906 but does not have an undulating or I-shaped longitudinally extending slot. In some embodiments, the male member 904 is inserted to the female member prior to forming the radially inwardly extending pins in the female member. In some embodiments, the male member 904 is coupled to knitting needle tip 902. Alternatively, the male member may be coupled to the flexible cable.

Figure 10:
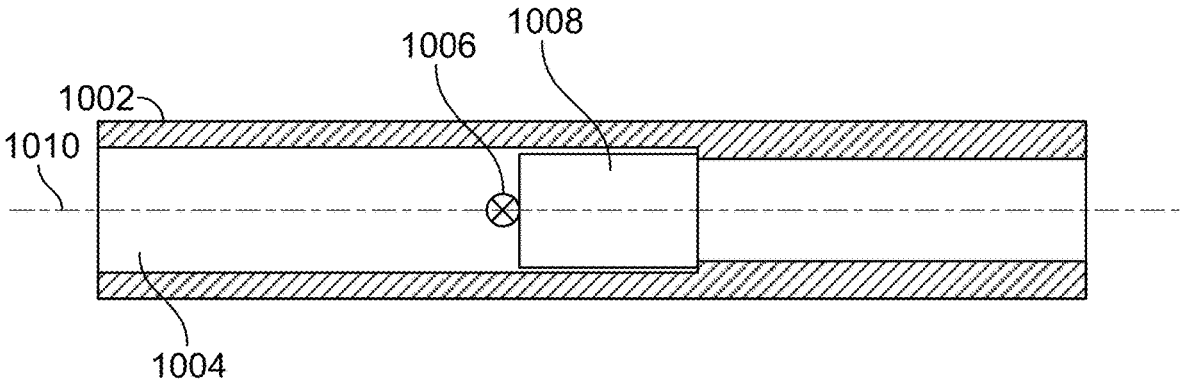
FIG. 10 is an exemplary depiction of a magnetic female member with at least one pin, according to some implementations of the subject matter of this disclosure.
Figure 11:
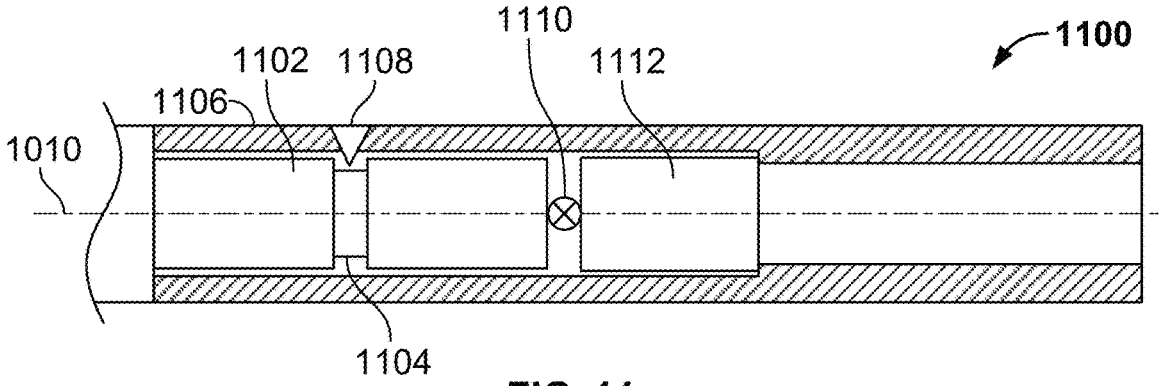
FIG. 11 shows a view of the exemplary connector assembly of FIG. 9 inserted into the exemplary female member of FIG. 10, according to some implementations of the subject matter of this disclosure.

FIG. 10 is an exemplary depiction of a magnetic female member 1002 with at least one pin 1006, according to some implementations of the subject matter of this disclosure. In some embodiments, the female member 1002 is without the second radially inwardly extending pin(s) for engaging the longitudinally extending slot(s) of some embodiments of the male member, at least initially. In such embodiments, there may still be one or more first radially inwardly protruding pin(s) 1006 to retain an optional magnet 1008 in a base of a bore 1004 of the female member 1002. In some embodiments, a second radially inwardly protruding pin(s) may be formed after a male member (e.g., male member 904) has been fully inserted into the base of the bore 1004 of the female member 1002, e.g., as illustrated in FIG. 11 and described further below. Radially inwardly protruding slot-engaging pin(s) may be formed (e.g., by crimping) in order to retain the male member in the female member 1002.

FIG. 11 shows a view of an exemplary connector assembly 1100 of a ferromagnetic male member 1102 with no longitudinal slot and a magnetic female member 1106 with at least one radially projecting feature or pin, according to some implementations of the subject matter of this disclosure. In an example, the male member 1102 is the male member 904 of FIG. 9, and the female member 1106 is female member 1002 of FIG. 10. In some embodiments, the male member 1102 may be inserted into the female member 1106, and subsequently the first radially inwardly protruding slot-engaging pin(s) 1108 may be formed (e.g., by crimping), with the second radially inwardly protruding pin(s) 1108 extending into the circumferentially extending radially outwardly facing slot 1104 of the male member 1102, and thereby retaining the male member 1102 within the female member 1106. In some embodiments, the circumferentially extending outwardly facing slot 1004 provides the ability for the male member 1102 (and, e.g., a knitting needle tip such as tip 902 of FIG. 9) to swivel relative to the female member 1106 along a common longitudinal axis 1010. In some embodiments, knitting needle connector assembly 1100 provides a relatively easier or more simple insertion of the male member 1102 with respect to the female member 1106 before the radially inwardly protruding pin 1108 is formed. In some embodiments, knitting needle connector assembly 1100 is useful where removal of the male member 1102 from the female member 1106 is not desired or practical, e.g., in a fixed circular knitting needle, as the pin(s) 1108 of the female member 1106 generally do not allow withdrawal of the male member 1102 from the female member 1106 without damaging or destroying the radially inwardly extending pin(s) 1108. As with other examples of connector assemblies described above 300, 800, a magnet 1112 may optionally be provided at the base of the bore of the female member 1106. It should be noted that the magnet 1112 may not be needed to an extent that the radially inwardly extending pin(s) 1108 adequately secure the male/female members together without allowing excessive longitudinal "wiggle," e.g., if the pin(s) 1108 are formed smaller than but very close to the size of circumferentially extending radially outwardly facing slots 1104, particularly in the connector assembly 1100.

As noted above, the knitting needle connector assembly 1100 in FIG. 11 may lend itself well to fixed knitting needle applications, e.g., fixed circulars, to the extent that the radially inwardly projecting pins 1108 do not allow removal of the male member 1102 from a female member 1106. Other examples of connector assemblies 300, 800 may lend themselves to interchangeable knitting needle applications, e.g., where a plurality of different knitting needle tips or members may be connected to a knitting needle cable. However, in some embodiments, knitting needle members/ tips of those example connector assemblies 300, 800 are permanently installed by formation of additional radially inwardly projecting pins 310, 810 after assembly of a male member 302, 802 to a corresponding female member 304, 804, respectively. In an alternative to the connector assembly 1100 in FIG. 11, a magnet 1112 may be provided that provides sufficient retention force of a male member 1102 in a female member 1106, wherein the circumferentially extending outwardly facing slot 1104 and/or radially inwardly projecting pins 1108 of the male/female members may be dispensed with entirely. In other words, if magnetic retention force is adequate to retain a male member 1102 within the female member 1106 during knitting, slots 1104 and corresponding radially projecting pins 1108 or other features may not be needed. Such an alternative connector assembly example may be useful for interchangeable knitting needle applications, by providing the ability to remove/replace knitting needle tips.

Figure 12:
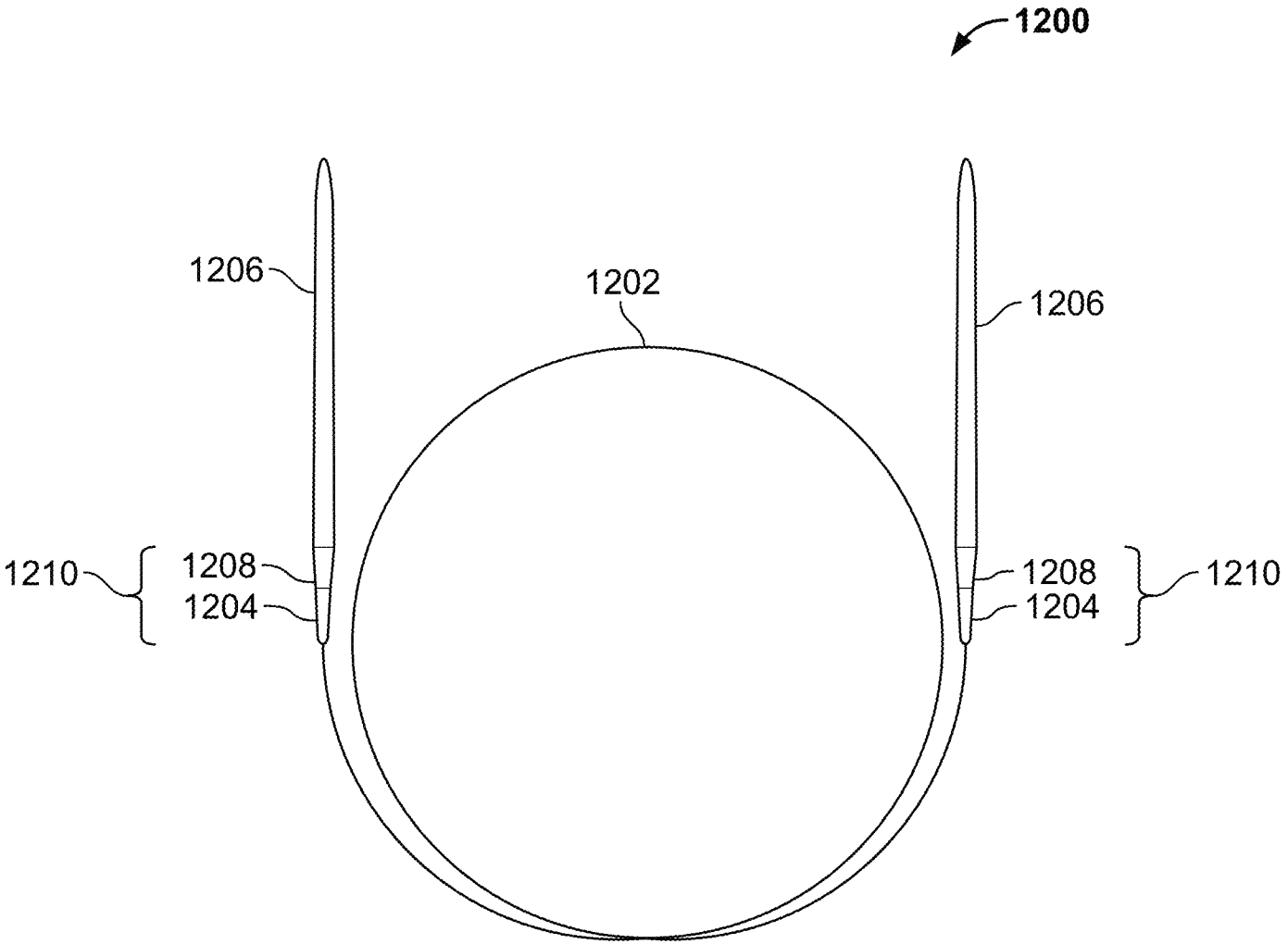
FIG. 12 is a top view of a circular knitting needle including two needle tips, with each secured to a flexible cable by way of respective swivel connector assemblies, according to implementations of the subject matter of this disclosure.

FIG. 12 is a top view of a circular knitting needle including two needle tips 1206, with each secured to a flexible cable 1202 by way of respective swivel connector assemblies 1210, according to implementations of the subject matter of this disclosure. In some embodiments, the swivel connector assemblies include a male member 1208 and a female member 1204. In some embodiments, the male members 1208 are coupled to the knitting needle tips 1206, while the female members 1204 are coupled to the flexible cable 1202. Alternatively, the configuration of the swivel connector assembly 1210 may switch such that the female members 1204 may be coupled to the knitting needle tips 1206 and the male members 1208 may be coupled to the flexible cable 1202. The connector assemblies 1210 may include any of the example connector assemblies described herein, without limitation.

Reference herein to "one example," "an example," "one embodiment," or "an embodiment" means that a particular feature, structure, or characteristic described in connection with the example is included in at least one example. The phrase "in one example" in various places in the specification does not necessarily refer to the same example each time it appears.

With regard to any processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments and should in no way be construed so as to limit a claimed invention.

Accordingly, it is to be understood that the above description is intended to be illustrative and not restrictive. Many embodiments and applications other than the examples provided would be upon reading the above description. The scope of inventions herein should be determined, not with reference to the above description, but should instead be determined with reference to the applicable claims, along with the full scope of equivalents to which such claims are entitled. It is anticipated and intended that future developments will occur in the arts discussed herein, and that the disclosed systems and methods will be incorporated into such future embodiments. In sum, it should be understood that inventions described herein are capable of modification and variation and is limited only by the applicable claims.

All terms used in applicable claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A knitting needle connector assembly, comprising:

a female member defining a bore, the bore having one or more radially inwardly protruding pins;

a male member coupled with the female member and inserted into the bore of the female member, the male member defining a circumferentially extending radially outwardly facing slot receiving the one or more pins; and a magnet positioned at a base of the bore of the female member adjacent an end of the male member, wherein a retention force applied by the magnet biases the male member and the female member together in an insertion direction;

wherein the one or more pins are movable about the circumferentially extending slot such that the female member is rotatable with respect to the male member about a common longitudinal axis of the male member and the female member, such that the female member is configured to swivel relative to the male member while the male member is inserted into and coupled with the female member;

wherein the male member defines a longitudinally extending slot configured to receive one of the one or more pins, the longitudinally extending slot meeting the circumferentially extending slot and configured to permit the one or more pins to slide along the longitudinally extending slot to the circumferentially extending slot during engagement of the male member with the female member and during disengagement of the male member from the female member; and wherein the longitudinally extending slot includes a laterally extending portion, such that during removal of the male member from the female member, the male member is moved longitudinally with respect to the female member in a first direction, the male member is subsequently rotated relative to the female member about the common longitudinal axis to move the one or more pins through the laterally extending portion, and the male member is subsequently moved longitudinally with respect to the female member in the first direction to disengage the male member from the female member.

2. The knitting needle connector assembly of claim 1, wherein the female member is configured to be secured to a knitting needle cable and the male member is configured to be secured to a knitting needle tip.

3. The knitting needle connector assembly of claim 1, wherein the one or more radially inwardly protruding pins comprise two pins.

4. The knitting needle connector assembly of claim 3, wherein the two pins are circumferentially spaced apart 180 degrees about the common longitudinal axis.

5. A knitting needle connector assembly, comprising:

a first member, the first member being generally cylindrical and having a radially facing slot extending circumferentially about a longitudinal axis of the first member; and a second member coupled with the first member, the second member having one or more radially projecting pins received in the circumferentially extending slot, wherein the one or more pins are movable about the circumferentially extending slot such that the first member is rotatable with respect to the second member about the longitudinal axis, such that the first member is configured to swivel relative to the second member while the first member is inserted into and coupled to the second member; and a magnet carried by the second member and positioned adjacent an end of the first member, wherein a retention force applied by the magnet biases the first member and the second member together in an insertion direction;

wherein the first member defines a longitudinally extending slot configured to receive one of the one or more pins during engagement and disengagement of the first and second members, the longitudinally extending slot meeting the circumferentially extending slot and configured to permit the one of the one or more pins to slide along the longitudinally extending slot to the circumferentially extending slot; and wherein the longitudinally extending slot includes a laterally extending portion, such that during disengagement of the first and second members, the first member is moved longitudinally with respect to the second member in a first direction, the first member is subsequently rotated relative to the second member about the longitudinal axis to move the one or more pins through the laterally extending portion, and the first member is subsequently moved longitudinally with respect to the second member in the first direction to disengage the first member from the second member.

6. The knitting needle connector assembly of claim 5, wherein the first member is a male member and the second member is a female member.

7. The knitting needle connector assembly of claim 5, wherein the first member includes a magnetically susceptible material.

8. The knitting needle connector assembly of claim 5, wherein one of the first and second members is configured to be secured to a knitting needle cable and the other of the first and second members is configured to be secured to a knitting needle tip, such that the knitting needle tip is configured to swivel relative to the knitting needle cable while the first member is coupled to the second member.

9. The knitting needle connector assembly of claim 5, wherein the longitudinally extending slot is a first longitudinally extending slot, and the first member defines a second longitudinally extending slot configured to receive a corresponding radially projecting feature.

10. The knitting needle connector assembly of claim 9, wherein the corresponding radially projecting feature is circumferentially spaced apart 180 degrees about the longitudinal axis from the one of the one or more pins of the second member.

11. The knitting needle connector assembly of claim 9, wherein the one or more radially projecting pins comprises two pins, the first longitudinally extending slot is configured to receive a first one of the two pins, and the corresponding radially projecting feature is a second one of the two pins.

12. The knitting needle connector assembly of claim 5, wherein the one or more radially projecting pins comprises two pins.

13. A knitting needle assembly, comprising:

a cable having opposing ends, each of the opposing ends having a knitting needle tip; and at least one knitting needle swivel connector assembly, the knitting needle swivel connector assembly coupling one of the knitting needle tips to one of the opposing ends of the cable, the knitting needle swivel connector assembly including:

a female member defining a bore, the bore having a radially inwardly protruding pin; and a male member inserted into the bore of the female member, the male member defining a circumferentially extending radially outwardly facing slot receiving the pin; and a magnet positioned at a base of the bore of the female member adjacent an end of the male member, wherein a retention force applied by the magnet biases the male member and the female member together in an insertion direction;

wherein the pin is movable about the circumferentially extending slot such that the female member is rotatable with respect to the male member about a common longitudinal axis of the male member and the female member, such that the one of the knitting needle tips is configured to swivel relative to the cable while the male member is inserted into and coupled with the female member;

wherein the male member defines a longitudinally extending slot configured to receive the pin, the longitudinally extending slot meeting the circumferentially extending slot and configured to permit the pin to slide along the longitudinally extending slot to the circumferentially extending slot during engagement of the male member with the female member and during disengagement of the male member from the female member; and wherein the longitudinally extending slot includes a laterally extending portion, such that during removal of the male member from the female member, the male member is moved longitudinally with respect to the female member in a first direction, the male member is subsequently rotated relative to the female member about the common longitudinal axis to move the pin through the laterally extending portion, and the male member is subsequently moved longitudinally with respect to the female member in the first direction to disengage the male member from the female member.

* * * * *